US009005765B2

(12) United States Patent
Wada et al.

(10) Patent No.: US 9,005,765 B2
(45) Date of Patent: Apr. 14, 2015

(54) METHOD FOR FORMING ANODIC OXIDE FILM, AND ALUMINUM ALLOY MEMBER USING THE SAME

(75) Inventors: Koji Wada, Kobe (JP); Jun Hisamoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 66 days.

(21) Appl. No.: 13/120,600

(22) PCT Filed: Sep. 16, 2009

(86) PCT No.: PCT/JP2009/066191

§ 371 (c)(1),
(2), (4) Date: Mar. 23, 2011

(87) PCT Pub. No.: WO2010/035674

PCT Pub. Date: Apr. 1, 2010

(65) Prior Publication Data

US 2011/0174627 A1 Jul. 21, 2011

(30) Foreign Application Priority Data

Sep. 25, 2008 (JP) ..... 2008-246381

(51) Int. Cl.

| | |
|---|---|
| ***B32B 15/04*** | (2006.01) |
| ***C25D 11/08*** | (2006.01) |
| ***C25D 11/06*** | (2006.01) |
| ***C25D 11/02*** | (2006.01) |

(52) U.S. Cl.

CPC ..... *C25D 11/06* (2013.01); *C25D 11/024* (2013.01)

(58) Field of Classification Search

None

See application file for complete search history.

(56) References Cited

U.S. PATENT DOCUMENTS

| | | | | |
|---|---|---|---|---|
| 5,431,802 | A * | 7/1995 | Sukimoto et al. | 205/131 |
| 5,775,892 | A * | 7/1998 | Miyasaka et al. | 418/55.2 |
| 6,444,304 | B1 * | 9/2002 | Hisamoto et al. | 428/319.1 |
| 8,404,059 | B2 | 3/2013 | Wada et al. | |
| 2007/0029207 | A1 * | 2/2007 | Anglin et al. | 205/300 |
| 2008/0169049 | A1 * | 7/2008 | Yakabe et al. | 148/222 |
| 2009/0050485 | A1 * | 2/2009 | Wada et al. | 205/50 |

FOREIGN PATENT DOCUMENTS

| | | | |
|---|---|---|---|
| JP | 08074091 | * | 3/1996 |
| JP | 2001-335989 | | 12/2001 |
| WO | 2008/018262 A1 | | 2/2008 |

OTHER PUBLICATIONS

Kruger et al. Applied Surface Science 186, , 2002, 374-380.*
U.S. Appl. No. 13/581,086, filed Aug. 24, 2012, Wada, et al.

* cited by examiner

*Primary Examiner* — Vera Katz
(74) *Attorney, Agent, or Firm* — Oblon, McClelland, Maier & Neustadt, L.L.P.

(57) ABSTRACT

Provided is an anodic oxide processing method in which the generation of cracks is suppressed in an anodic oxide film formed on an aluminum alloy substrate surface, such as an inner wall of a vacuum chamber of a plasma processing device, and an anodic oxide film having low heat reflectivity and a high withstand voltage is formed with high efficiency. The method for forming an anodic oxide film involves forming the anodic oxide film on the surface of a JIS 6061 aluminum alloy substrate in a sulfuric acid solution or a mixed acid solution of sulfuric acid and oxalic acid.

11 Claims, No Drawings

METHOD FOR FORMING ANODIC OXIDE FILM, AND ALUMINUM ALLOY MEMBER USING THE SAME

TECHNICAL FIELD

The present invention relates to a method for efficiently forming an anodic oxide film (anodic oxide coating) on a vacuum chamber and on an aluminum member to be arranged in the vacuum chamber, which chamber is used in plasma processing equipment typically for the production of semiconductors and liquid crystals, and which anodic oxide film shows excellent cracking resistance and has a low heat reflectance. The present invention also relates to an aluminum alloy member having a film formed by the method.

BACKGROUND ART

Vacuum chambers and various parts to be arranged in the chambers in plasma processing equipment typically for the production of semiconductors and liquid crystals mainly adopt aluminum alloys (metals). The aluminum alloys generally have an anodized aluminum film (anodic oxide film) formed through anodization on their surface, because the chambers and members are exposed to a corrosive gas such as chlorine-containing or bromine-containing gas and/or to plasma in an environment at room temperature to 200° C. or higher in a pretreatment process and/or in a production process. However, the anodic oxide film formed on the aluminum alloy may include some cracks, and the cracks may increase in number and/or grow in size in the high-temperature environment, and the corrosive gas invaded from the cracks may cause the corrosion of the base metal aluminum alloy. In particular, the anodic oxide film to be formed on the chambers and members in the processing equipment is formed to be relatively thick because the chambers and members are exposed to a plasma atmosphere and should have higher plasma resistance. However, such a relatively thick anodized oxide film is more susceptible to cracking and tends to fail to have sufficient corrosion resistance. To avoid this, Patent Literature (PTL) 1, for example, discloses an anodized aluminum-based metal material which bears an anodic oxide film and shows improved corrosion resistance, in which cracks in the anodic oxide film are filled with a burnt amorphous-silicon-containing substance formed by supplying an organic treatment solution to the anodic oxide film, which organic treatment solution is of an organic compound having a Si content of 10 atomic percent or more and having Si—O bonds in an organic solvent, and drying and firing the organic treatment solution.

CITATION LIST

Patent Literature

PTL 1: Japanese Unexamined Patent Application Publication (JP-A) No. 2001-335989

Independently, a processing using plasma, such as film deposition through chemical vapor deposition (CVD) or dry etching, is performed in the plasma processing equipment on the surface of a glass substrate for a liquid crystal device or on the surface of a silicon wafer (semiconductor). In this process, it is difficult to perform a desired processing unless the temperature of the wafer or substrate is precisely controlled. For this reason, a heater is embedded in a mounting table for a work such as a wafer or substrate in the CVD film deposition process; and a cooling water channel is provided in the mounting table in the dry etching process. In addition to the heater and cooling mechanism, exemplary heat sources which affect the temperature of the work include energy possessed by the plasma, and heat generated by a reaction between the plasma and the work.

SUMMARY OF INVENTION

Technical Problem

However, the technique for improving the corrosion resistance by filling cracks with a burnt amorphous-silicon-containing substance as disclosed in PTL 1 requires a complicated processing process and thereby shows a poor production efficiency, in which an anodic oxide film is formed on an (Al-based) metal substrate, the organic treatment solution is supplied to the anodic oxide film while heating the metal substrate, and the anodic oxide film is then fired to fill cracks in the film with the burnt amorphous-silicon-containing substance. Independently, the heat generated and emitted from the heat sources in the vacuum chamber is reflected by the inner wall of the vacuum chamber and by the various parts arranged in the chamber and travels again to the work to cause further temperature rise of the work. Especially in the dry etching process in which the work needs to be cooled, the temperature rise of the work may adversely affect the processing accuracy. Accordingly, the inner wall of the vacuum chamber and the parts arranged in the chamber should have a low heat reflectance. In addition, the anodic oxide film should not cause heavy-metal contamination therefrom and should have low film (formation) cost. The anodic oxide film should also have a satisfactory withstand voltage (dielectric strength) so as to be resistant to dielectric breakdown, because the equipment members such as the vacuum chamber and the parts arranged in the chamber are applied with a high voltage for the generation of plasma, and this may cause the dielectric breakdown of the anodic oxide film. The withstand voltage increases with an increasing integrated voltage during anodization, but remarkably decreases by the presence of cracks in the film.

Accordingly, an object of the present invention is to provide an anodizing method for efficiently forming an anodic oxide film on a surface of an aluminum alloy typically constituting an inner wall of a vacuum chamber typically of plasma processing equipment, which anodic oxide film less suffers from cracking, has a low heat reflectance and a high withstand voltage, and less causes heavy-metal contamination therefrom.

Solution to Problem

Specifically, to achieve the object, the present invention provides a method for forming an anodized oxide film, which method having the configurations of the following (1) to (3).

(1) A method for forming an anodic oxide film, the method including the step of anodizing a surface of a Japanese Industrial Standards (JIS) 6061 aluminum alloy substrate in a solution of sulfuric acid or in a solution of an acid mixture of sulfuric acid and oxalic acid to form the anodic oxide film thereon, in which the anodization is performed at an integrated voltage in a film thickness direction over the entire thickness of the formed anodic oxide film of 1650 V·μm or more, the anodization is performed at a bath voltage (electrolytic voltage) of 27 V or less to form the anodic oxide film in a region from a position 25 μm, in the film thickness direction, above from an interface between the aluminum alloy substrate and the anodic oxide film to the surface of the anodic oxide film, and the anodization is performed at an integrated voltage of 820 V·μm or more and 1000 V·μm or less to form the anodic oxide film in a region from the interface to the position 25 μm, in the film thickness direction, above from the interface.

The present inventors made investigations on a method for forming an anodic oxide film which suffers less from cracking and has a low heat reflectance. Initially, the present inventors employed, as an electrolyte, sulfuric acid or a solution of an acid mixture of sulfuring acid and oxalic acid, because sulfuric acid is available at low cost, is easy to be managed, and does not contain substances harmful to the electrolyte; and oxalic acid does not cause heavy-metal contamination. The present inventors performed anodization in the specific electrolyte to form a series of anodic oxide films on an aluminum alloy substrate, and measured the heat reflectances of anodic oxide films formed at different parameters, i.e., at different bath voltages and different integrated voltages, which integrated voltages are obtained by integrating, in the film thickness direction, the product between the bath voltage and the film thickness. As a result, the present inventors found that the integrated voltage in the film thickness direction over the entire thickness of the film, i.e., the total integrated voltage is set to be 1650 V·μm or more, and preferably 1800 V·μm or more, to allow the anodic oxide film to have a heat reflectance of 15% or less, which is an acceptability criterion empirically determined as a result of actual use of the equipment members, as described later. This means that a larger film thickness or a higher bath voltage allows the formed film to have a lower heat reflectance. Specifically, this is probably because such an anodic oxide film generally has a porous film structure; the volume of its solid portion increases with an increasing bath voltage and with an increasing film thickness; and the anodic oxide film having a large volume of its solid portion more absorbs the heat emitted from the heat sources in the vacuum chamber while the heat passes through the film, and the film shows a lower heat reflectance.

In contrast, it is generally known that cracking in the film decreases with a smaller film thickness and a lower bath voltage. Next, the present inventors performed anodization in the electrolyte at a varying bath voltage while setting an integrated voltage (total integrated voltage) in the film thickness direction over the entire thickness of the film to about 1650 V·μm, to form a series of anodic oxide films on an aluminum alloy substrate; and measured an amount of cracking, i.e., a crack density (total length (mm) of cracks per film unit area ($mm^2$)). As a result, they experimentally found that anodization is appropriately performed at a bath voltage of 27 V or less, because, when formed at an increased bath voltage of approximately 30 V, the film has a crack density of more than acceptability criterion (i.e., 1) and shows remarkably impaired cracking resistance, which acceptability criterion is empirically determined through the actual use of the equipment members as in the heat reflectance; and that the film formation, if performed at an integrated voltage of 1000 V·μm or less, does not significantly affect the cracking, i.e., does not significantly affect the crack density in the film, in which the integrated voltage is integrated in a region from an interface between the aluminum alloy substrate and the anodic oxide film to a position 25 μm, in the film thickness direction, above from the interface. The film formation (anodization) is performed at a bath voltage of preferably 5 V or more, and more preferably 10 V or more, and the film formation is suitably performed at an integrated voltage in a region from the interface to the position 25 μm, in the film thickness direction, above from the interface of 820 V·μm or more, because, with a decreasing bath voltage, the current passing through the electrolyte decreases, i.e., the film is formed at a lower rate, thus resulting in a decreasing productivity. To perform anodization at an integrated voltage in a region from the interface to 25 μm, in the film thickness direction, from above the interface of 820 V·μm or more and 1000 V·μm or less, the voltage may be increased within this region. However, the rate of voltage increase is desirably set as appropriate according to the composition and temperature of the electrolyte, and the bath voltage, because an abrupt voltage rise may cause a large current to pass through the film during its formation on the aluminum alloy substrate and may thereby cause melting of the film.

The anodization solution (electrolyte) may have, as its composition, a regular sulfuric acid concentration (i.e., a weight of sulfuric acid of 100 to 300 g per 1 liter of the electrolyte). When the electrolyte is a solution of an acid mixture of sulfuric acid and oxalic acid, it can be a mixture of a solution of sulfuric acid having the above sulfuric acid concentration with oxalic acid added in a regular amount (40 g or less per 1 liter of the electrolyte). The anodization solution (electrolyte) may have such a temperature that does not cause freezing of the anodization solution (about 0° C.) or higher. However, an excessively low anodization solution temperature may cause inferior productivity, because the current during electrolysis is low and thereby the film is formed at a lower speed. In contrast, an excessively high anodization solution temperature may cause an excessively high current during electrolysis, and this may cause the melting of the film during formation and may thereby impede the film formation. These phenomenon depend on the composition of the anodization solution and the bath voltage, and the anodization solution temperature can be set as appropriate according to the composition and voltage. After performing desired anodization, the aluminum alloy substrate may be subjected to a hydration treatment typically by immersing in hot water or exposing to a superheated steam. However, the hydration treatment causes the film to be susceptible to cracking, and hydration treatment conditions, such as temperature of and immersing time in the hot water, and temperature of and exposing time to the superheated steam, should be set as appropriate.

The measured data of the heat reflectance and crack density demonstrate that even a thick film satisfies requirements both in heat reflectance and in crack density, when formed while controlling the bath voltage to be low (27 V or less) as not to impair the productivity and controlling the integrated voltage to a certain level (1650 V·μm) or more.

(2) The method for forming an anodic oxide film according to (1), in which a surface of the aluminum alloy substrate has such a profile as to have a peak count Pc per unit measurement length of 70 counts per millimeter (mm) or more, and the peak count Pc is determined by measuring a roughness of the surface with a surface roughness meter at a measurement length of 4 mm and a cutoff value of 0.8 mm to plot a roughness curve and an average line thereof, and counting two intersection points between the roughness curve and the average line as one peak count Pc.

The aluminum alloy substrate, when having the surface profile, allows the film to absorb the emitted heat further more, because the heat emitted from the heat sources in the vacuum chamber undergoes irregular reflection at the surface of the aluminum alloy substrate, and the irregularly reflected heat comes again into the surface of the anodic oxide film. The peak count Pc of the surface of the substrate can be controlled by any of a physical process such as shot blasting or a chemical process such as dissolution of the substrate surface with a chemical solution typically containing a commercially available acidic ammonium fluoride pretreatment agent for aluminum alloys. The peak count Pc of the substrate surface can be measured with a commercially available surface roughness meter. The peak count Pc is more preferably 100 counts per millimeter or more. As used herein the terms roughness curve, cutoff value, and average line are defined according to Japanese Industrial Standards (JIS) B 0601; and the roughness curve is a curve corresponding to a profile curve from which surface undulating components longer than a predetermined wavelength are removed through a filter.

(3) An aluminum alloy member including an anodic oxide film formed by the method according to (1) or (2), in which the aluminum alloy member is used as a vacuum chamber of plasma processing equipment and/or as a member arranged in the vacuum chamber.

When the above anodic oxide film is formed into an inner wall of a vacuum chamber and into an aluminum alloy member arranged in the chamber, the aluminum alloy substrate constituting these members reflects a less amount of heat, and this suppresses temperature rise of the work during plasma processing and thereby reduces adverse effects caused by such temperature rise on the processing accuracy. This configuration also suppresses the cracking in the anodic oxide film and thereby improves the corrosion resistance of the aluminum alloy substrate.

Advantageous Effects of Invention

According to the present invention, a film having both a low heat reflectance and a low crack density and showing a high withstand voltage can be formed as an anodic oxide film on an aluminum alloy substrate to be used as a vacuum chamber of plasma processing equipment and as parts arranged in the vacuum chamber. This is achieved by performing anodization in a solution of sulfuric acid or in a solution of an acid mixture of sulfuric acid and oxalic acid serving as an electrolyte while controlling both the bath voltage and the integrated voltage as integrated over the entire film thickness in the film thickness direction. The anodic oxide film can show a further lower heat reflectance by controlling the surface roughness of the aluminum alloy substrate. The low heat reflectance suppresses the temperature rise of the work during plasma processing and mitigates the adverse effects on the processing accuracy. In addition, the low crack density and high withstand voltage improves the corrosion resistance of the aluminum alloy substrate to be exposed to plasma.

In addition, the electrolyte in anodization performed according to the present invention is available at low cost, is easy to be managed, and avoids contamination typically of heavy metals and harmful substances, because the electrolyte as used herein is a solution of sulfuric acid or a solution of an acid mixture of sulfuric acid and oxalic acid.

DESCRIPTION OF EMBODIMENTS

Some embodiments of the present invention will be illustrated below, with reference to several working examples.

The anodic oxide film according to the present invention can be formed on a surface of the aluminum alloy substrate using customarily known anodization equipment. The integrated voltage is a value obtained by adding (integrating) the product V×Δda of a bath voltage V and a film thickness Δda at intervals of the predetermined film thickness Δda (for example, 5 μm) over the entire film thickness during the anodization process from beginning to end. The thickness da of the anodic oxide film during the anodization process is determined by previously determining, in a preliminary test, the relationship between the electrolysis time (process time) t and the film thickness da at several different bath voltages V in the range of the bath voltage for use in the anodization; and determining the thickness da of the film formed on the surface of the aluminum alloy substrate from the electrolysis time (process time) in the actual anodization based on the previously determined relationship between the electrolysis time (process time) t and the film thickness da. In the preliminary test, the film thickness da can be measured nondestructively using a known eddy-current coating thickness meter.

In the preliminary test, the relationship between the integrated electricity Vs and the film thickness da may also be previously determined. The integrated electricity Vs is an integrated value of the current density Id (i.e., (current I)/(film area S)) with respect to the electrolysis time (process time) t and can be determined with a current integrator or determined by measuring currents and integrating the measured currents on a computer. In this case, the film thickness da equals (coefficient C)×(integrated electricity Vs). By previously determining the coefficient C, the film thickness da during the anodization can be calculated from the measured integrated electricity Vs.

The anodic oxide film generally has a heat reflectance of 15% or less as determined in terms of reflectance at a wave number of 3000 $cm^{-1}$ using the Bio-Rad DIGILAB dynamically-aligned step-scan interferometer FTS-60A/896.

The anodic oxide film generally has a crack density of 1 $mm/mm^2$ or less, and preferably 0.5 $mm/mm^2$ or less, in terms of crack density ($mm/mm^2$) determined by measuring the total length (mm) of cracks through observation in an observation area of 0.235 mm long and 0.180 mm wide with an optical microscope, and converting the total length of cracks into a value per unit area ($mm^2$) of the observation area.

EXAMPLES

A series of anodized oxide films was formed on a surface of a specimen through the anodization using a solution of sulfuric acid or a solution of an acid mixture of sulfuric acid and oxalic acid as an anodization solution (electrolyte). The specimen used herein was an aluminum alloy substrate made of a JIS 6061 alloy and having a size of 30-mm square and a thickness of 2 mm. Table 1 shows anodization conditions and anodization results. The integrated voltage Vp in a region from an interface between the aluminum alloy substrate and the anodic oxide film to a position 25 μm above from the interface, and the total integrated voltage Vt in a region from the interface to the film surface shown in Table 1 were respectively determined by previously determining the relationship between the conducting period (process time) t and the thickness da of the film formed on the substrate surface and, based on this relationship, determining and integrating the product (V×Δda) of the integrated voltage V and the film thickness Δda at intervals of the film thickness Δda while setting the film thickness Δda at 5 μm. The heat reflectance was measured in terms of reflectance at a wave number of 3000 $cm^{-1}$ using the Bio-Rad DIGILAB dynamically-aligned step-scan interferometer FTS-60A/896, and a sample having a heat reflectance of 15% or less was accepted herein. At the time when the anodization was performed, the film contained cracks. Accordingly, the crack density was determined by measuring the total length (mm) of cracks through observation in an observation area of 0.235 mm long and 0.180 mm wide with an optical microscope, and converting the total length of cracks into a value per unit area ($mm^2$) of the observation area. A sample having a crack density of 1 or less was accepted herein. Regarding the total process time, a sample having a total process time of 60% or less of the process time at a single bath voltage, i.e., a representative bath voltage which requires a longest conducting period in the anodization (film formation) process was accepted. In addition, the withstand voltage of the film was measured according to a known testing method on some of the specimens.

TABLE 1

| No. | Pc count/mm | Anodization solution (g/L) Sulfuric acid | Anodization solution Oxalic acid | Anodization solution temperature (° C.) | Total film thickness (μm) | Electrolysis voltage (V) Interface to 25 μm | Electrolysis voltage (V) 25 μm to film surface | Integrated voltage (V · μm) Interface to 25 μm | Integrated voltage (V · μm) Interface to film surface | Heat reflectance (%) | Crack density (mm/mm$^2$) | Withstand voltage (V) | Total process time (h) | Example/Comparative Example |
|---|---|---|---|---|---|---|---|---|---|---|---|---|---|---|
| 1 | 56 | 150 | 10 | 5 | 55 | 29-38 | 27 | 840 | 1650 | 13 | 0.3 | 3300 | 4 | Example |
| 2 | 52 | 150 | 10 | 5 | 50 | 32-45 | 27 | 975 | 1650 | 14 | 0.5 | | 2.8 | Example |
| 3 | 44 | 200 | | 10 | 65 | 30-35 | 20 | 850 | 1650 | 14 | 0.3 | | 4.6 | Example |
| 4 | 48 | 200 | | 10 | 60 | 25-52 | 20 | 950 | 1650 | 13 | 0.5 | | 4 | Example |
| 5 | 60 | 200 | | 10 | 60 | 25-52 | 20 | 950 | 1650 | 9 | 0.4 | | 4 | Example |
| 6 | 80 | 200 | | 10 | 60 | 25-52 | 20 | 950 | 1650 | 5 | 0.3 | | 4 | Example |
| 7 | 48 | 200 | | 10 | 50 | 20 | 20 | | 1600 | 25 | 0.1 | | | Comparative Example |
| 8 | 44 | 200 | | 10 | 65 | 25 | 25 | | 1625 | 20 | 0.2 | | | Comparative Example |
| 9 | 52 | 150 | 10 | 5 | 55 | 30 | 30 | | 1650 | 14 | 1.1 | 1100 | | Comparative Example |
| 10 | 56 | 150 | 10 | 5 | 60 | 30 | 30 | | 1800 | 5 | 1.5 | | | Comparative Example |
| 11 | 48 | 200 | | 10 | 85 | 20 | 20 | 500 | 1700 | 10 | 0.1 | | 8 | Comparative Example |
| 12 | 44 | 150 | 10 | 5 | 65 | 27 | 27 | 675 | 1755 | 8 | 0.2 | | 7 | Comparative Example |
| 13 | 56 | 200 | | 10 | 75 | 22-29 | 20 | 655 | 1655 | | 0.2 | | 6.5 | Comparative Example |
| 14 | 52 | 150 | 10 | 5 | 60 | 28-38 | 27 | 815 | 1760 | | 0.3 | | 5 | Comparative Example |
| 15 | 44 | 150 | 10 | 5 | 45 | 32-55 | 27 | 1110 | 1650 | | 3 | | | Comparative Example |
| 16 | 48 | 200 | | 10 | 55 | 25-57 | 20 | 1050 | 1650 | | 2 | 990 | | Comparative Example |

Table 1 demonstrates as follows. Specifically, samples (No. 7 and No. 8) formed at a total integrated voltage from the interface between the aluminum alloy substrate and the film to the film surface of less than 1650 V·μm have crack densities satisfying the acceptability criterion but show heat reflectances of about 20% to about 25% not satisfying the acceptability criterion. Samples (No. 9 and No. 10) formed at a total integrated voltage of 1650 V·μm or more but at a bath voltage of 30 V, exceeding 27 V, in a region from the position 25 μm above from the interface between the aluminum alloy substrate and the anodic oxide film to the film surface have crack densities not satisfying the acceptability criterion. Samples (No. 11 to No. 14) formed at an integrated voltage in a region from the interface to a position 25 μm above therefrom of less than 820 V·μm require long process times, even though they are formed at a total integrated voltage of 1650 V·μm or more and at a bath voltage in a region between the position 25 μm above from the interface and the film surface of 27 V or less. Samples (No. 15 to No. 16) formed at an integrated voltage in a region from the interface to a position 25 μm above therefrom of more than 1000 V·μm have crack densities not satisfying the acceptability criterion, even though they are formed at a total integrated voltage of 1650 V·μm or more and at a bath voltage in a region between the position 25 μm above from the interface and the film surface of 27 V or less. In contrast, samples (No. 1 to No. 6) satisfy all the acceptability criteria regarding the heat reflectance, crack density, and process time, because they are formed under conditions satisfying all the requirements, i.e., at a total integrated voltage of 1650 V·μm or more, at a bath voltage in a region between the position 25 μm above from the interface and the film surface of 27 V or less, and at an integrated voltage in a region from the interface to a position 25 μm above therefrom of 820 V·μm or more and 1000 V·μm or less. Thus, the inner wall of a vacuum chamber on which the anodic oxide film is formed, and parts arranged in the chamber can satisfy all the acceptability criteria for the heat reflectance, the crack density of the film, and the anodization time, by controlling the bath voltage so as to have a total integrated voltage at 1650 V·μm or more, a bath voltage in a region between the position 25 μm above from the interface and the film surface of 27 V or less, and an integrated voltage in a region from the interface to a position 25 μm above therefrom of 820 V·μm or more and 1000 V·μm or less in anodization using a solution of sulfuric acid or a solution of an acid mixture of sulfuric acid and oxalic acid at a concentration within a desired range. Of samples formed at the same bath voltage and at the same integrated voltage, samples (No. 4 to No. 6) show a decreasing heat reflectance and a decreasing crack density with an increasing peak count Pc; of which a sample (No. 6) having a peak count Pc of 80 shows a very low heat reflectance of 5%. Even though being formed at the same total integrated voltage of 1650 V·μm, a sample (No. 9) formed at a bath voltage of more than 27 V and a sample (No. 16) formed at an integrated voltage in a region from the interface to 25 μm above therefrom of more than 1000 V·μm have low withstand voltages of 1100 V and 990 V, respectively; but, in contrast to this, a sample (No. 1) formed at a bath voltage and at a total integrated voltage both within the ranges specified in the present invention has a high withstand voltage of 3300 V.

While the present invention has been described with reference to the specific embodiments thereof, it is obvious to those skilled in the art that various changes and modifications can be made in the present invention without departing from the spirit and scope of the present invention.

The present application is based on Japanese Patent Application No. 2008-246381 filed on Sep. 25, 2008, the entire contents of which are incorporated herein by reference.

INDUSTRIAL APPLICABILITY

According to the present invention, a film having both a low heat reflectance and a low crack density and showing a high withstand voltage can be formed as an anodic oxide film on an aluminum alloy substrate to be used as a vacuum chamber of plasma processing equipment and as parts arranged in the vacuum chamber. This is achieved by performing anodization in a solution of sulfuric acid or in a solution of an acid mixture of sulfuric acid and oxalic acid serving as an electrolyte while controlling both the bath voltage and the integrated voltage as integrated over the entire film thickness in the film thickness direction. The anodic oxide film can show a further lower heat reflectance by controlling the surface roughness of the aluminum alloy substrate. The low heat reflectance suppresses the temperature rise of the work during plasma processing and mitigates the adverse effects on the processing accuracy. In addition, the low crack density and high withstand voltage improves the corrosion resistance of the aluminum alloy substrate to be exposed to plasma.

In addition, the electrolyte in anodization performed according to the present invention is available at low cost, is easy to be managed, and avoids contamination typically of heavy metals and harmful substances, because the electrolyte as used herein is a solution of sulfuric acid or a solution of an acid mixture of sulfuric acid and oxalic acid.

The invention claimed is:

1. A method for forming an anodic oxide film, the method comprising:

anodizing a surface of a Japanese Industrial Standards (JIS) 6061 aluminum alloy substrate in a solution of sulfuric acid or in a solution of an acid mixture of sulfuric acid and oxalic acid to form the anodic oxide film thereon, wherein the anodic oxide film has a crack density of 1 mm/mm$^2$ or less and a heat reflectance of 15% or less, the anodizing is performed at an integrated voltage in a film thickness direction over the thickness of the anodic oxide film formed of 1650 V·μm or more, the anodizing is performed at a bath voltage of 27 V or less to form the anodic oxide film in a region from a position 25 μm, in the film thickness direction, above from an interface between the aluminum alloy substrate and the anodic oxide film to a surface of the anodic oxide film, and the anodizing is performed at an integrated voltage of 820 V·μm or more and 1000 V·μm or less to form the anodic oxide film in a region from the interface to the position 25 μm, in the film thickness direction, above from the interface.

2. The method of claim 1, wherein a surface of the aluminum alloy substrate has such a profile as to have a peak count Pc per unit measurement length of 70 counts per millimeter (mm) or more, and the peak count Pc is determined by measuring a roughness of the surface with a surface roughness meter at a measurement length of 4 mm and a cutoff value of 0.8 mm to plot a roughness curve and an average line thereof, and counting two intersection points between the roughness curve and the average line as one peak count Pc.

3. The method of claim 1, wherein the anodizing is performed at an integrated voltage in a film thickness direction over the entire thickness of the anodic oxide film formed of 1800 V·μm or more.

4. The method of claim 1, wherein the anodizing is performed at a bath voltage of 27 V to 5 V.

5. The method of claim 1, wherein the anodizing is performed at a bath voltage of 27 V to 10 V.

6. An aluminum alloy member, comprising an anodic oxide film formed by a method comprising:

anodizing a surface of a Japanese Industrial Standards (JIS) 6061 aluminum alloy substrate in a solution of sulfuric acid or in a solution of an acid mixture of sulfuric acid and oxalic acid to form the anodic oxide film thereon, wherein the anodic oxide film has a crack density of 1 mm/mm$^2$ or less and a heat reflectance of 15% or less, the anodizing is performed at an integrated voltage in a film thickness direction over the thickness of the anodic oxide film formed of 1650 V·μm or more, the anodizing is performed at a bath voltage of 27 V or less to form the anodic oxide film in a region from a position 25 μm, in the film thickness direction, above from an interface between the aluminum alloy substrate and the anodic oxide film to a surface of the anodic oxide film, the anodizing is performed at an integrated voltage of 820 V·μm or more and 1000 V·μm or less to form the anodic oxide film in a region from the interface to the position 25 μm, in the film thickness direction, above from the interface, and the aluminum alloy member is at least one selected from the group consisting of a vacuum chamber of plasma processing equipment and a member arranged in the vacuum chamber.

7. The aluminum alloy member of claim 6, wherein a surface of the aluminum alloy substrate has such a profile as to have a peak count Pc per unit measurement length of 70 counts per millimeter (mm) or more, and the peak count Pc is determined by measuring a roughness of the surface with a surface roughness meter at a measurement length of 4 mm and a cutoff value of 0.8 mm to plot a roughness curve and an average line thereof, and counting two intersection points between the roughness curve and the average line as one peak count Pc.

8. The aluminum alloy member of claim 6, wherein the anodizing is performed at an integrated voltage in a film thickness direction over the entire thickness of the anodic oxide film formed of 1800 V·μm or more.

9. The aluminum alloy member of claim 6, wherein the anodizing is performed at a bath voltage of 27 V to 5 V.

10. The aluminum alloy member of claim 6, wherein the anodizing is performed at a bath voltage of 27 V to 10 V.

11. The aluminum alloy of claim 6, wherein the anodic oxide film has a crack density of 0.5 mm/mm$^2$ or less.

* * * * *